US008256617B2

(12) United States Patent
Gomes et al.

(10) Patent No.: US 8,256,617 B2
(45) Date of Patent: Sep. 4, 2012

(54) CARRIER FOR CONTAINERS

(75) Inventors: Jean-Manuel Gomes, Marietta, GA (US); Charles F. Ho Fung, Marietta, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 402 days.

(21) Appl. No.: 12/411,656

(22) Filed: Mar. 26, 2009

(65) Prior Publication Data

US 2009/0242445 A1 Oct. 1, 2009

Related U.S. Application Data

(60) Provisional application No. 61/040,344, filed on Mar. 28, 2008.

(51) Int. Cl.
*B65D 75/00* (2006.01)

(52) U.S. Cl. .... 206/427; 206/147; 206/162; 229/117.09

(58) Field of Classification Search ..... 206/427, 206/145, 147, 151, 152, 153, 158, 161, 162, 206/194, 163, 165, 166; 229/117.09, 117.15, 229/117.19

See application file for complete search history.

(56) References Cited

U.S. PATENT DOCUMENTS 2,694,518 A * 11/1954 Zanck et al. ..... 229/120.01
2,737,326 A 3/1956 Toensmeier
2,764,284 A 9/1956 Arneson
2,950,041 A 8/1960 Stone
2,975,934 A * 3/1961 Powell ..... 206/192
3,198,378 A * 8/1965 Farquhar ..... 206/194
3,245,711 A 4/1966 Dantoin
3,612,266 A 10/1971 Graser
3,722,945 A 3/1973 Wood
3,767,041 A 10/1973 Graser
3,860,281 A * 1/1975 Wood ..... 294/87.2
4,180,191 A * 12/1979 Wood ..... 294/87.2
4,188,766 A 2/1980 Culpepper
4,192,540 A 3/1980 Oliff
4,244,617 A * 1/1981 Manizza ..... 294/87.2
4,318,476 A * 3/1982 Wood et al. ..... 206/459.5
4,326,628 A 4/1982 Wood
4,336,898 A 6/1982 Joyce
(Continued)

FOREIGN PATENT DOCUMENTS

DE 196 42 571 A1 5/1997
(Continued)

*Primary Examiner* — J. Gregory Pickett
*Assistant Examiner* — Ernesto Grano
(74) *Attorney, Agent, or Firm* — Womble Carlyle Sandridge & Rice, LLP

(57) ABSTRACT

A carrier is for holding a plurality of containers. The carrier comprises a bottom panel comprising a plurality of bottom openings, and a first side panel and a second side panel. A first top panel is foldably connected to the first side panel and a second top panel is foldably connected to the second top panel. The first top panel and the second top panel form a top wall of the carrier. The first top panel comprises a first handle portion, the second top panel comprises a second handle portion. A handle is foldably connected to at least one of the side panels. The handle comprises the first handle portion and the second handle portion, is separable from the top wall, and pivotable between a lowered position and a raised position. A blank for forming a carrier and a method for forming a carrier are also generally disclosed.

41 Claims, 14 Drawing Sheets

U.S. PATENT DOCUMENTS

| | | | | | |
|---|---|---|---|---|---|
| 4,432,579 | A | | 2/1984 | Denmark et al. | |
| 4,438,843 | A | | 3/1984 | Graser | |
| 4,566,591 | A | | 1/1986 | Turtschan et al. | |
| 5,135,104 | A | | 8/1992 | Jorba | |
| 5,188,225 | A | | 2/1993 | Jorba | |
| 5,273,156 | A | | 12/1993 | Harris | |
| 5,323,895 | A | | 6/1994 | Sutherland et al. | |
| 5,344,006 | A | * | 9/1994 | Mazzeo | 206/153 |
| 5,351,815 | A | | 10/1994 | Fogle et al. | |
| 5,407,065 | A | | 4/1995 | Sutherland | |
| 5,445,262 | A | | 8/1995 | Sutherland | |
| 5,484,059 | A | | 1/1996 | Sutherland | |
| 5,503,267 | A | | 4/1996 | Sutherland | |
| 5,505,304 | A | * | 4/1996 | Broskow et al. | 206/427 |
| 5,598,920 | A | | 2/1997 | Hansen | |
| 5,638,956 | A | | 6/1997 | Sutherland | |
| 5,687,838 | A | | 11/1997 | Bakx | |
| 5,738,217 | A | | 4/1998 | Hunter | |
| 5,746,310 | A | | 5/1998 | Slomski | |
| 5,816,391 | A | | 10/1998 | Harris | |
| 5,820,185 | A | | 10/1998 | Gomes | |
| 5,845,776 | A | | 12/1998 | Galbierz et al. | |
| 5,878,876 | A | * | 3/1999 | Galbierz et al. | 206/158 |
| 5,960,945 | A | | 10/1999 | Sutherland | |
| 5,984,086 | A | | 11/1999 | Foushee et al. | |
| D420,575 | S | * | 2/2000 | Rovere | D9/752 |
| 6,021,897 | A | | 2/2000 | Sutherland | |
| 6,223,891 | B1 | | 5/2001 | Devens et al. | |
| 6,223,892 | B1 | | 5/2001 | Bakx | |
| 6,315,111 | B1 | | 11/2001 | Sutherland | |
| 6,488,322 | B2 | | 12/2002 | Bakx | |
| 6,615,984 | B2 | | 9/2003 | Saulas et al. | |
| 7,264,114 | B2 | | 9/2007 | Daniel | |
| 2004/0079666 | A1 | | 4/2004 | Bakx | |
| 2004/0226833 | A1 | | 11/2004 | Daniel | |

FOREIGN PATENT DOCUMENTS

| | | | |
|---|---|---|---|
| DE | 203 17 334 | U1 | 2/2004 |
| DE | 20 2004 004 248 | U1 | 8/2004 |
| DE | 20 2004 017 954 | U1 | 2/2005 |
| EP | 0 048 506 | | 3/1982 |
| EP | 0 285 043 | A1 | 10/1988 |
| EP | 0 398 835 | B1 | 11/1990 |
| EP | 0 495 197 | A1 | 7/1992 |
| EP | 0 541 334 | A1 | 5/1993 |
| EP | 0 780 320 | A1 | 6/1997 |
| EP | 1 070 671 | A1 | 1/2001 |
| EP | 1 384 679 | A1 | 1/2004 |
| ES | 200700203 | | 1/2007 |
| FR | 1 582 235 | | 9/1969 |
| FR | 2 525 992 | | 11/1983 |
| FR | 2 664 239 | | 1/1992 |
| FR | 2 731 413 | | 9/1996 |
| GB | 1 342 180 | | 12/1973 |
| GB | 2 085 391 | A | 4/1982 |
| GB | 2 158 037 | A | 11/1985 |
| WO | WO 97/33807 | | 9/1997 |
| WO | WO 98/49071 | | 11/1998 |
| WO | WO 99/01356 | | 1/1999 |
| WO | WO 02/059011 | A2 | 8/2002 |
| WO | WO 02/062676 | A1 | 8/2002 |
| WO | WO 02/079048 | A1 | 10/2002 |
| WO | WO 03/016167 | A1 | 2/2003 |
| WO | WO 2005/095222 | A1 | 10/2005 |
| WO | WO 2006/044583 | A2 | 4/2006 |
| WO | WO 2006/108098 | A1 | 10/2006 |
| WO | WO 2007/044525 | A1 | 4/2007 |
| WO | PCT/US2009/038347 | | 3/2009 |

* cited by examiner

CARRIER FOR CONTAINERS

CROSS-REFERENCE TO RELATED APPLICATIONS

This application claims the benefit of U.S. Provisional Application No. 61/040,334 which was filed on Mar. 28, 2008. The entire content of the above-referenced provisional application is hereby incorporated by reference as if presented herein in its entirety.

BACKGROUND OF THE DISCLOSURE

The present disclosure generally relates to packages or carriers for holding, displaying, and/or carrying containers.

SUMMARY OF THE DISCLOSURE

In general, one aspect of the disclosure is directed to a carrier for holding a plurality of containers. The carrier comprises a bottom panel comprising a plurality of bottom openings for at least partially receiving a respective container of the plurality of containers. At least two side panels extend upward from the bottom panel. The at least two side panels comprise a first side panel and a second side panel. At least two top panels comprise a first top panel foldably connected to the first side panel and a second top panel foldably connected to the second top panel. The first top panel and the second top panel cooperate to form a top wall of the carrier. The first top panel comprises a first handle portion, the second top panel comprises a second handle portion. A handle is for carrying the carrier. The handle is foldably connected to at least one of the side panels. The handle comprises the first handle portion and the second handle portion. The handle is separable from the top wall and pivotable between a lowered position and a raised position.

In another aspect, the disclosure is generally directed to a blank for forming a carrier for holding a plurality of containers. The blank comprises a bottom panel comprising a plurality of bottom openings for at least partially receiving a respective container of the plurality of containers. At least two side panels comprise a first side panel and a second side panel. At least two top panels comprise a first top panel foldably connected to the first side panel and a second top panel foldably connected to the second top panel. The first top panel comprises a first handle portion. The second top panel comprises a second handle portion. The blank has handle features for forming a handle of the carrier formed from the blank. The handle features comprise the first handle portion and the second handle portion. The first and second handle portions are respectively foldably connected to one of the first top panel and the second top panel.

In another aspect, the disclosure is generally directed to a method of forming a carrier for containing a plurality of containers. The method comprises providing a blank having a bottom panel comprising a plurality of bottom openings, at least two side panels comprising a first side panel and a second side panel, at least two top panels comprising a first top panel and a second top panel. The first top panel is foldably connected to the first side panel and comprises a first handle portion. The second top panel is foldably connected to the second side panel and comprises a second handle portion. The blank comprises handle features comprising the first handle portion and the second handle portion. The method further comprises respectively upwardly folding the at least two side panels to position the side panels to extend upwardly from the bottom panel. The method comprises forming a top wall by placing the first top panel and the second top panel in generally face-to-face relationship. The forming the top wall comprises forming a handle by placing the first handle portion and the second handle portion in generally face-to-face relationship. The method further comprises downwardly folding the top wall. The downwardly folding the top wall comprises placing the handle in a lowered position adjacent to one of the side panels.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure generally relates to carriers, constructs, sleeves, cartons, or the like, and packages for holding and displaying containers such as jars, bottles, cans, etc. The containers can be used for packaging food and beverage products, for example. The containers can be made from materials suitable in composition for packaging the particular food or beverage item, and the materials include, but are not limited to, plastics such as PET, LDPE, LLDPE, HDPE, PP, PS, PVC, EVOH, and Nylon; and the like; aluminum and/or other metals; glass; or any combination thereof.

Carriers according to the present disclosure can accommodate containers of numerous different shapes. For the purpose of illustration and not for the purpose of limiting the scope of the disclosure, the following detailed description describes beverage product containers (e.g., plastic containers) at least partially disposed within the carrier embodiments. In this specification, the terms "lower," "bottom," "upper" and "top" indicate orientations determined in relation to fully erected carriers or packages.

The present embodiments are addressed to carriers or packages for attachment to and accommodation of containers. A carrier or package 150 is illustrated in its erected state in FIGS. 6 and 7, in which it is attached to containers C. In the illustrated embodiments the containers C are illustrated as three beverage containers each having a top portion generally comprising an upper neck portion N (FIG. 2), a cap CP, and an annular shoulder S below the cap. Less than or more than three containers C can be held in the carrier 150, and the containers can be otherwise sized and shaped without departing from the disclosure. The carrier 150 includes a handle 7 (FIG. 7) for grasping and carrying the carrier.

Figure 1:
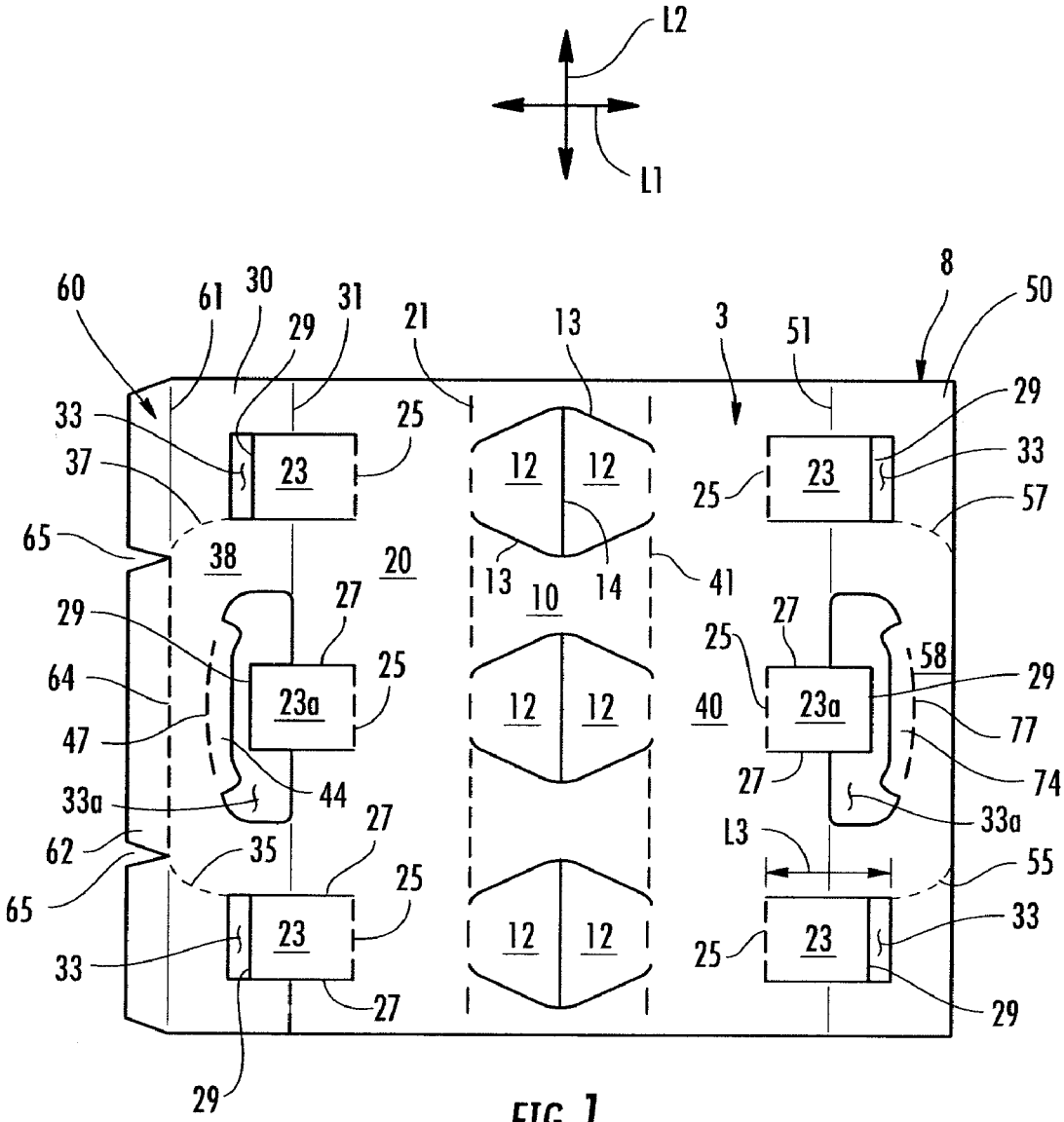
FIG. 1 is a plan view of the exterior side of a blank according to a first embodiment of the disclosure.

FIG. 1 is a plan view of an exterior side 3 of a blank 8 used to form the carrier or package 150. The blank 8 has a longitudinal axis L1 and a lateral axis L2. The blank 8 comprises a bottom panel 10 foldably connected to a first side panel 20 at a first transverse fold line 21, a first top panel 30 foldably connected to the first side panel 20 at a second transverse fold line 31, a second side panel 40 foldably connected to the bottom panel 10 at a third transverse fold line 41, and a second top panel 50 foldably connected to the second side panel 40 at a fourth transverse fold line 51. In the illustrated embodiment, the blank 8 includes an adhesive panel 60 foldably connected to the first top panel 30 at a fifth transverse fold line 61.

One or more cuts may be included in each of the transverse fold lines 21, 31, 41, 51, 61 to facilitate folding along the fold lines. Any number of cuts may be formed in any of the fold lines, and the number and length of the cuts may be selected according to, for example, the gauge and/or the stiffness of the material used to form the blank 8. The fold lines 21, 31, 41, 51, 61 may be formed by other methods (e.g., crease lines without cuts) without departing from the disclosure.

The bottom panel 10 comprises pairs of opposed retention flaps 12 that are respectively foldably attached to the blank by portions of the fold lines 21, 41. The flaps 12 are defined by cut or tear lines 13 and separated by cuts 14. Each pair of flaps 12 open to respectively form an opening 15 (FIG. 2) in the bottom panel that is shaped and sized to receive the upper neck portion N of a container C (FIG. 2) that is to be at least partially accommodated within the carrier 150. The blank 8 could comprise more or less than three pairs of flaps 12 and bottom openings 15 without departing from the disclosure.

In the embodiment of FIGS. 1-7, the blank 8 includes three reinforcement flaps 23, 23*a* foldably attached to the first side panel 20 and three reinforcement flaps 23, 23*a* foldably attached to the second side panel 40. Each reinforcement flap 23, 23*a* is foldably connected at a respective lateral fold line 25 in the side panels 20, 40 and is at least partially defined by longitudinal cuts 27 extending from the lateral fold line to an edge 29 of the flap. The edge 29 of each reinforcement flap 23, 23*a* is adjacent a respective opening 33, 33*a* in the top panels 30, 50. Each reinforcement flap 23, 23*a* has a length L3 in the longitudinal direction L1 so that the flaps engage a portion of the annular shoulder S of a respective container C that is held in the carrier 150 when the flap 23, 23*a* is folded about a respective fold line 25. When the reinforcement flaps 23, 23*a* are folded, the openings 33, 33*a* then extend into the side panels 20, 40 and the edges formed by the reinforcement flaps 23, 23*a* at the fold lines 25 are adjacent to the respective side openings 33, 33*a*. The flaps 23, 23*a* cooperate with the respective flaps 12 and side panels 20, 40 to form a retaining edge 24 (FIG. 5) under either side of each shoulders S. The flaps 23, 23*a* may be otherwise shaped, arranged, and positioned without departing from the disclosure.

The first and second top panels 30, 50 include handle features for forming the handle 7 of the carrier 150. The central openings 33*a* that are adjacent each of the central flaps 23*a* is a handle opening that is shaped for receiving a hand of a user when the handle 7 is grasped to carry the carrier 150. The first top panel 30 includes a first handle portion 38 that is a portion of the first top panel that is at least partially defined by the central opening 33*a*, portions of the lateral fold line 31 between cut lines 27 and the central opening 33*a*, a central portion 64 of the lateral fold line 61, and two curved tear lines 35, 37 extending from respective, laterally outer openings 33 to the lateral fold line 61. The handle features optionally include a comfort flap 44 foldably attached to the handle portion 38 by a curved fold line 47. In one embodiment, the handle features include a central portion 62 of the adhesive panel 60 that is independently foldably attached to the handle portion 38 at the central portion 64 of the lateral fold line 61. V-shaped notches 65 in the adhesive panel 60 separate the central portion 62 from the remainder of the adhesive panel.

In the illustrated embodiment, the handle features comprise a second handle portion 58 that is a portion of the second top panel 50 and is similar in shape and functionality as the handle portion 38 in the first top panel 30. The second handle portion 58 is at least partially defined by the central opening 33*a* in the second top panel 50, portions of the lateral fold line 51 between respective cuts 27 and the central opening 33*a*, and two curved tear lines 55, 57 extending from respective outer openings 33 to the edge of the blank 8. The handle features optionally include a comfort flap 74 foldably attached to the handle portion 58 by a curved fold line 77.

Figure 2:
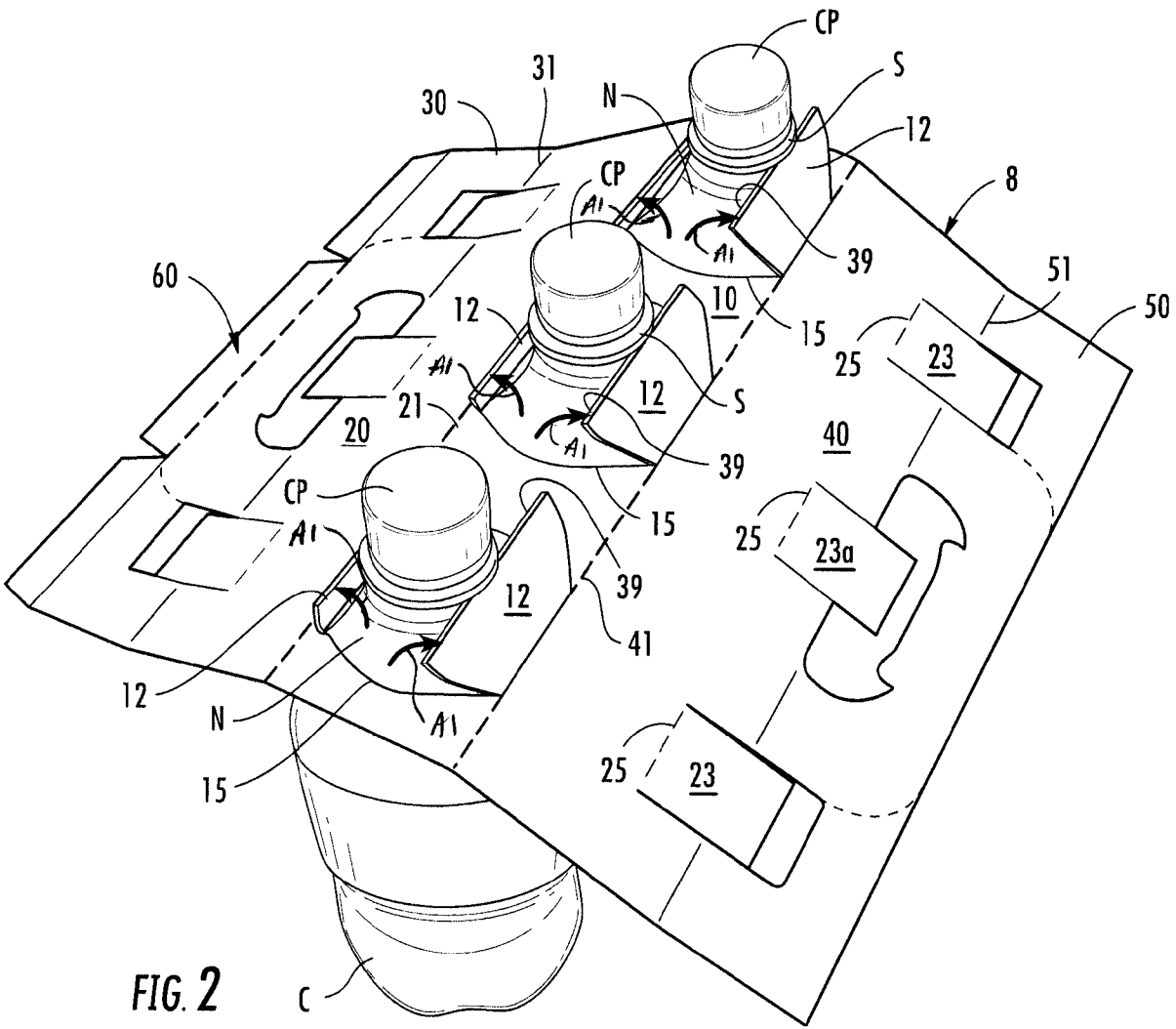
FIGS. 2-6 are perspective views of exemplary steps in assembling the carrier according to the first embodiment of the disclosure.
Figure 3:
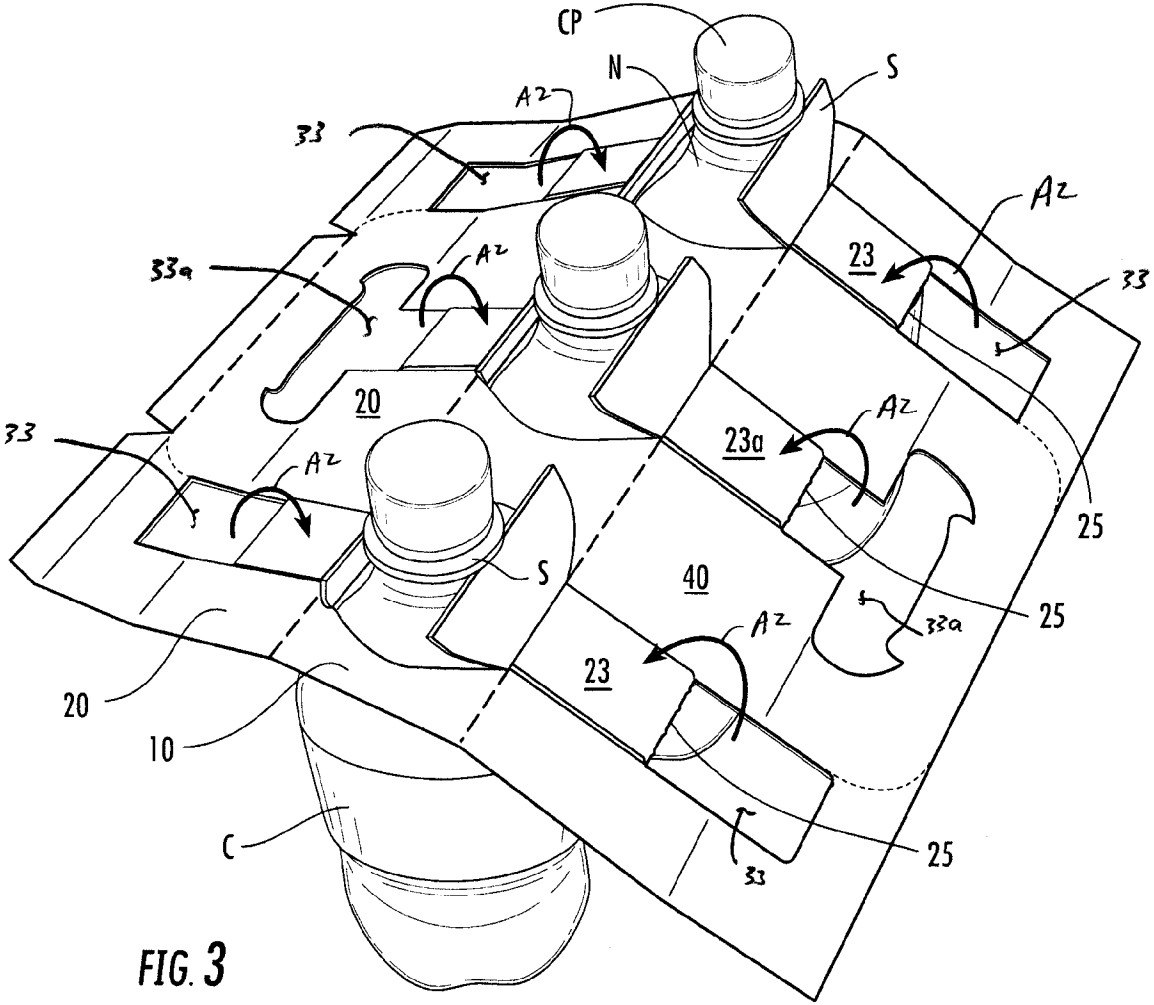
Figure 4:
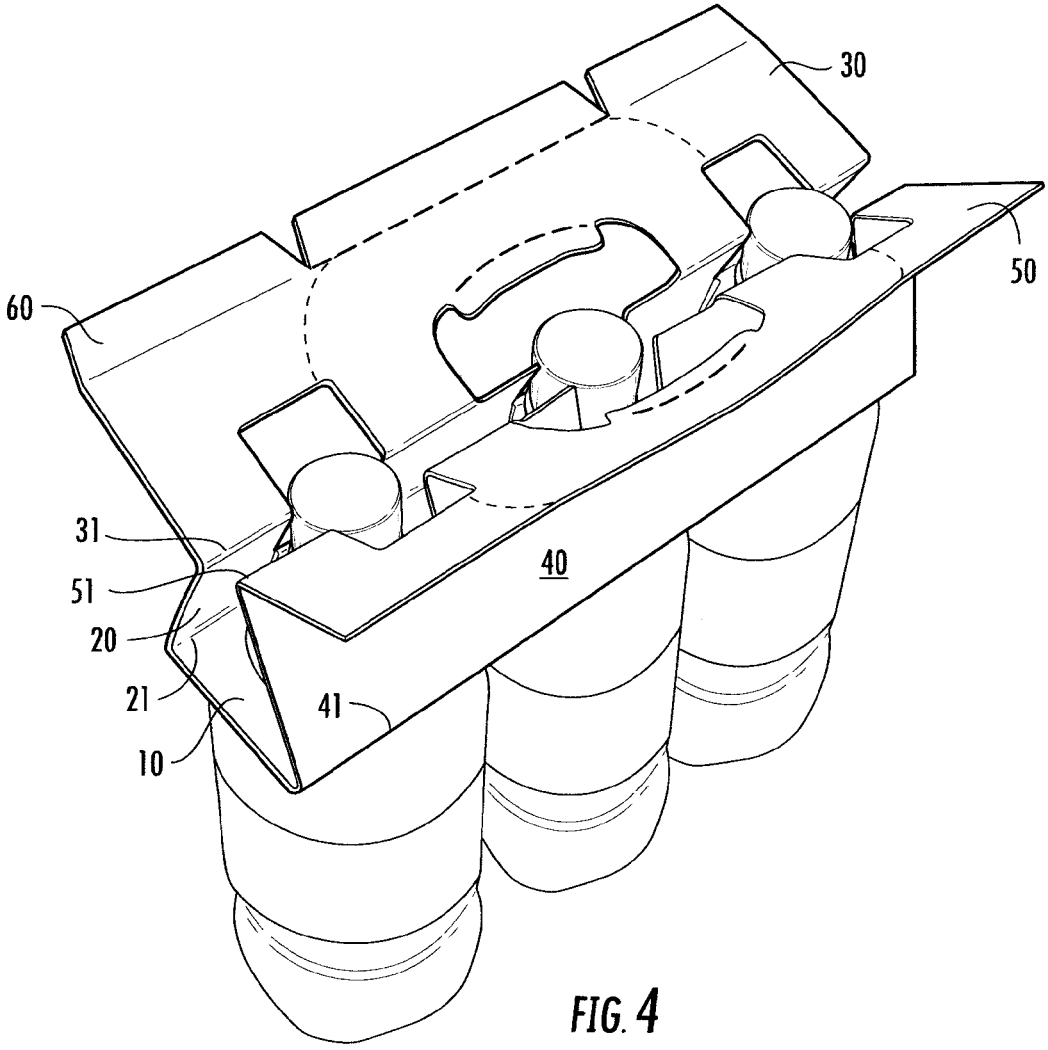

As illustrated in FIGS. 2-7, the blank 8 may be erected into the carrier 150 by placing the blank 8 onto the containers C such that the neck portion N of each of the containers is respectively received in the openings 15 of the bottom panel 10 and the flaps 12 are respectively upwardly folded in the direction of arrows A1 (FIG. 2). The flaps 12 each have a respective edge 39 that engages a shoulder S or other suitable feature at opposite sides of the containers C to at least partially provide a retaining force for holding the containers in the carrier. As shown in FIG. 3, the optional reinforcement flaps 23, 23*a* are respectively folded about fold lines 25 in the direction of arrows A2, so that the flaps are in face-to-face contact with respective portions of the first side panel 20 and the second side panel 40. The reinforcement flaps 23, 23*a* can be respectively adhesively secured (e.g., glued) to the first and the second side panel 20, 40 or the flaps may be unattached to the side panels without departing from the disclosure. The first and second side panel 20, 40 are respectively folded relative to the bottom panel 10 along respective fold lines 21, 41, so that the first and second side panels each are oriented at an acute angle relative to the bottom panel (FIG. 4). The openings 33, 33*a* in the side panels 20, 40 are brought into axial alignment with the openings 15 of the bottom panel 10. In one embodiment, the bottom panel 10 is substantially horizontal and the side panels 20, 40 are angled inward to cooperate with the bottom panel to form a closed triangular space 105 when viewed in cross section. In the upwardly folded position of the side panels 20, 40, the reinforcement flaps 23, 23*a* engage the shoulders S of the containers at opposite sides of the containers to supplement the retaining force of the flaps 12.

Figure 5:
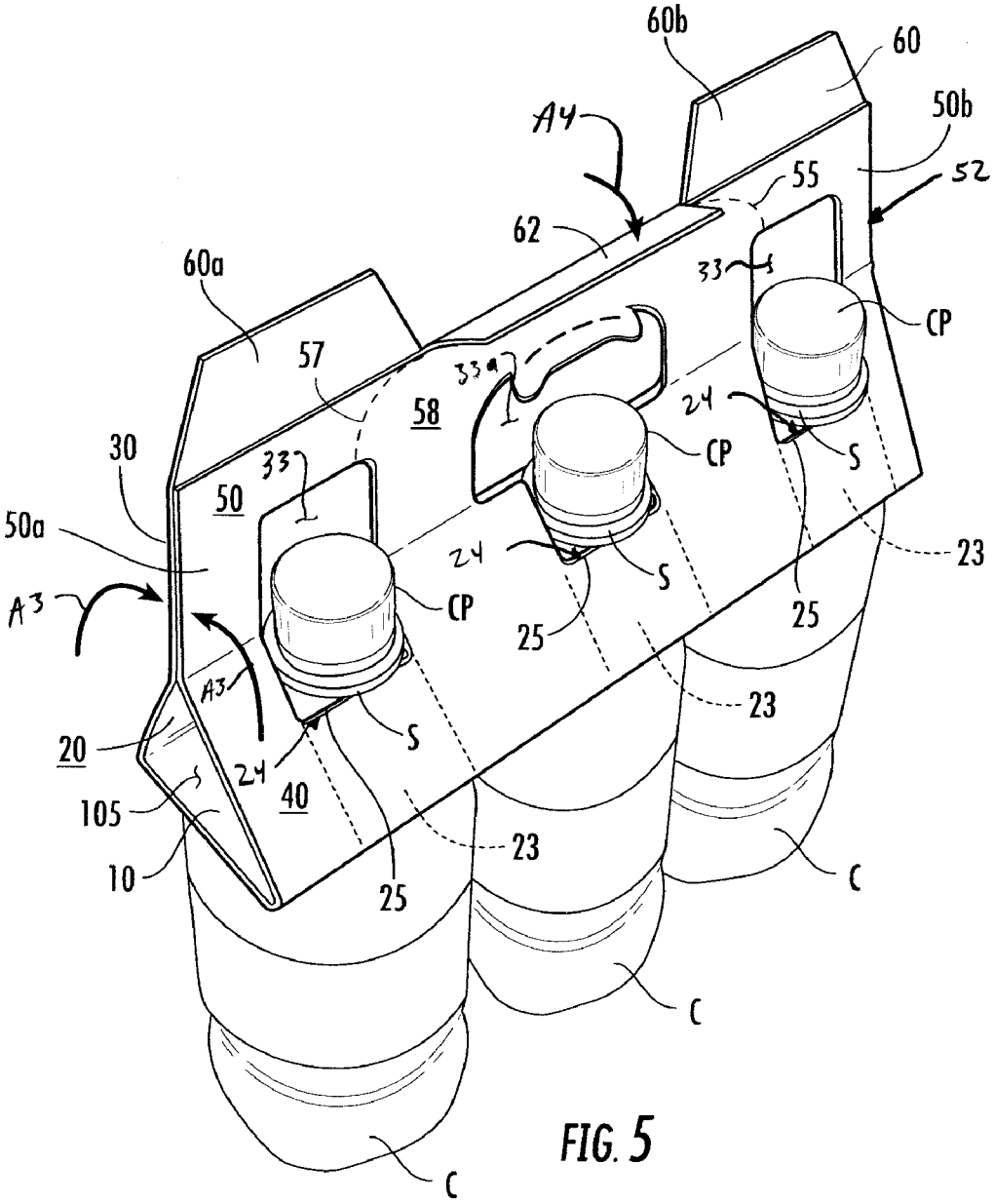
Figure 6:
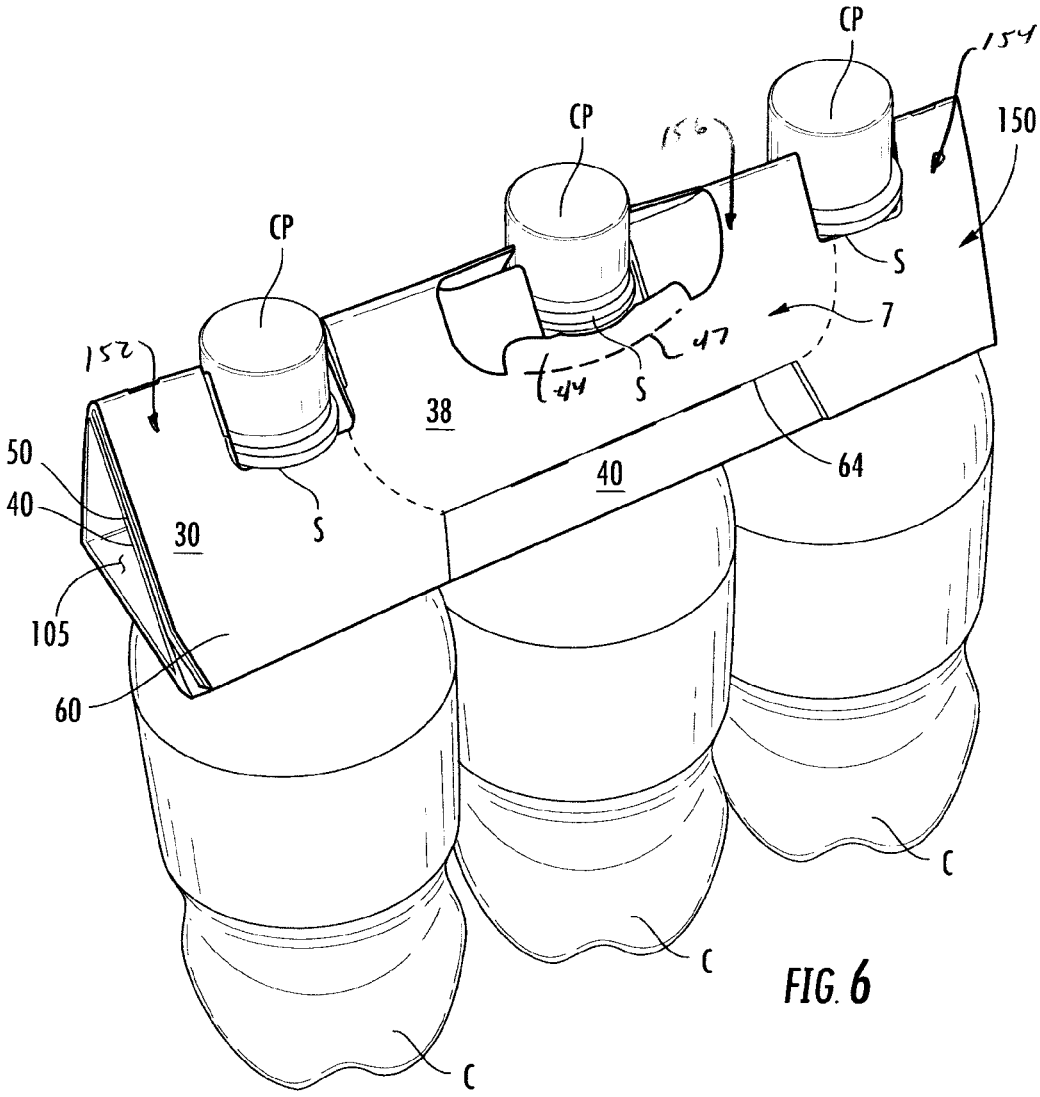
Figure 6A:
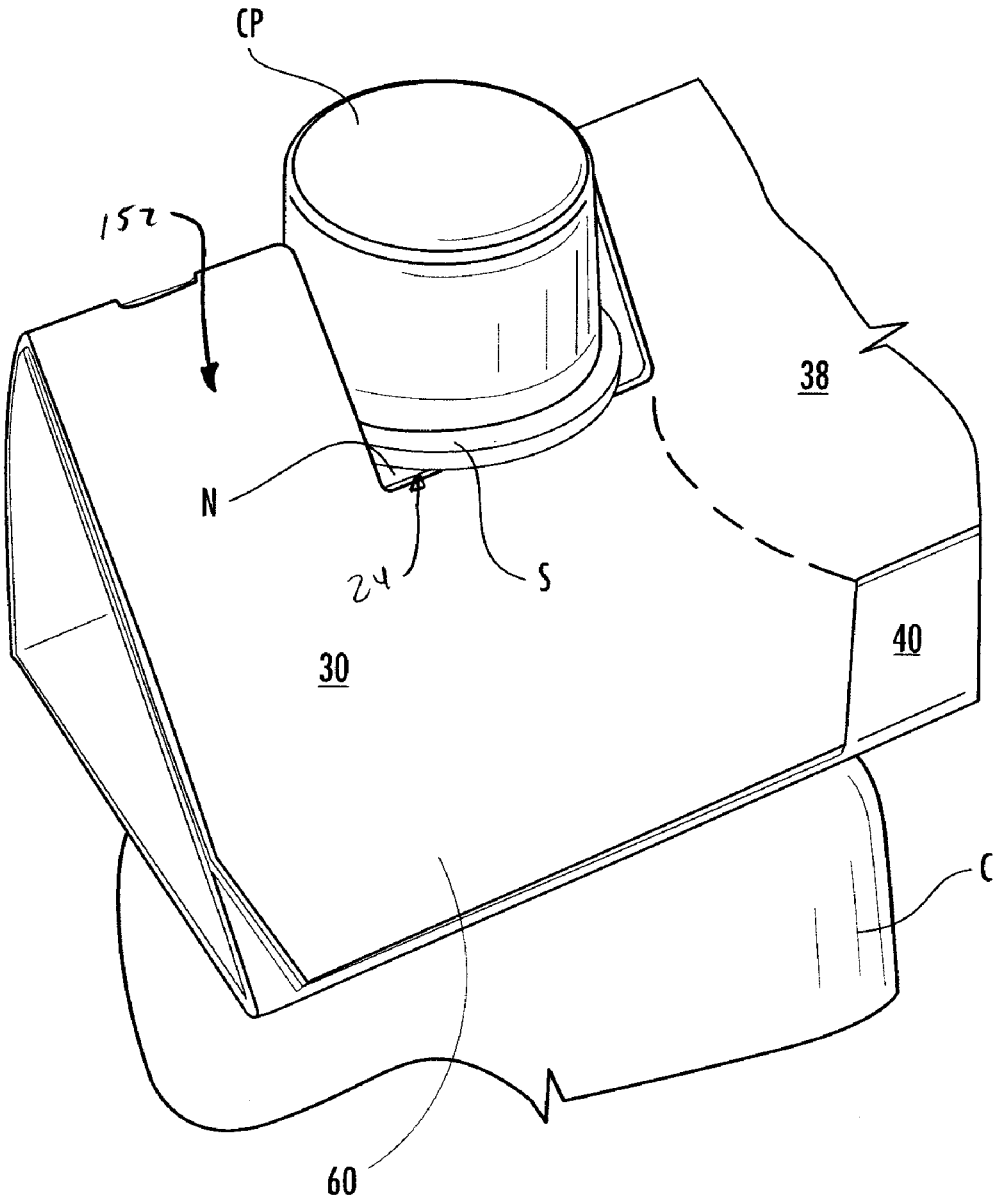
FIG. 6A is a detail view of an end of the carrier of FIG. 6.

Next, the top panels 30, 50 are folded in the direction of arrows A3 and are brought together in face-to-face contact to form a top wall 52 and so that the top panels extend generally vertically upward from the first and second side panels 20, 40. The top wall 52 has openings corresponding to the portions of the openings 33, 33*a* that extend into each of the top panels 30, 50. The top panels 30, 50 can be adhered together with glue or other suitable adhesive. The central portion 62 of the adhesive panel 60 can be downwardly folded in the direction of arrow A4 and adhered to the overlapped first and second handle portions 38, 58 of the attached first and second top panel 30, 50. Next, the top wall 52, including the adhered first and second top panels 30, 50, is downwardly folded and attached to the second side panel 40 (FIG. 6). The portions of the openings 33, 33*a* that form the openings in the top wall 52 are brought into alignment with the portions of the openings 33, 33*a* in the side panels 20, 40 and the openings 15 in the bottom panel. Adhesive may be applied to portions of the second top panel 50 (e.g. portions 50*a*, 50*b* (FIG. 5) respectively located laterally outward of tear lines 57, 55) and/or the outer portions of the adhesive panel 60 (e.g. portions 60*a*, 60*b* (FIG. 5) respectively located laterally outward of central portion 62) to secure the top wall 52 in the position shown in FIG. 6. Care should be taken when applying adhesive to ensure the overlapped first and second handle portions 38, 58 are not adhered to the second side panel 40.

Figure 7:
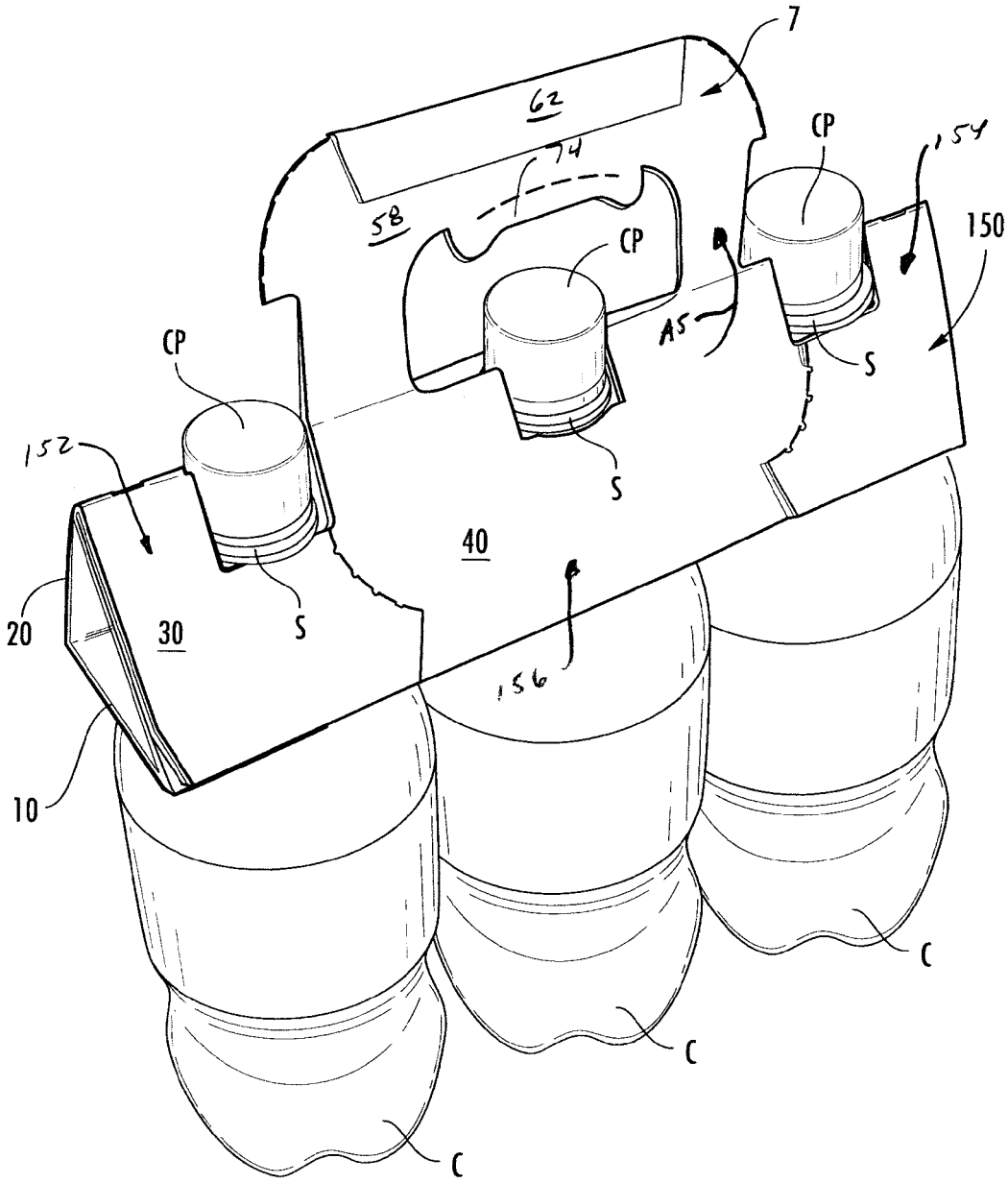
FIG. 7 is a perspective view of the carrier of FIG. 6 with the handle in the raised position.

The handle 7 of the carrier 150 can be activated by grasping the overlapped handle portions 38, 58 at the central portion 64 of the fold line 61 connecting the first top panel 30 to the adhesive flap 60. In the position of FIG. 5, the central portion 62 of the adhesive panel 60 has been placed between the second side panel 40 and the second top panel 30 to create an edge corresponding to the central portion 64 of the fold line 61 for grasping and activating the handle 7. The combined handle portions 38, 58 are respectively separated from the first top panel 30 and the second top panel 50 by tearing along respective tear lines 35, 37, 55, 57 and pivoting the combined handle portions 38, 58 upward in the direction of arrow A5 (FIG. 7) along the overlapped central portions of the fold lines 31, 51 that respectively foldably attached the handle portions to the side panels 20, 40. In the lowered position of the handle 7 (FIG. 6), the edge of the overlapped comfort flaps 44, 74 can engage a portion of the shoulder S of the middle container C to supplement the retaining force of the carrier 150 and to retain the handle in the lowered position. As shown in FIG. 7, the handle 7 is activated for grasping the carrier 150 when the combined handle portions 38, 58 have been extended upwardly from the top edges of the side panels 20, 40.

Optionally, the handle 7 is initially attached to one of the side panels 20, 40 (e.g. side panel 40 (FIG. 6)) so that handle is retained in the downwardly folded position until activation by a consumer who purchases the carrier 150. The handle 7 is attached to one of the side panels 20, 40 by adhesive applied between the laterally outer portions of the overlapped top panels 30, 50 and the laterally outer portions of the one side panel that the handle is attached to. The overlapped handle portions 38, 58 remain free from adhesive attachment to the side panels 20, 40 so that the handle portions can be separated from the attached portion of the top panels 30, 50 via tear lines 35, 37, 55, 57. Further, the two-ply handle 7 including overlapped and adhered first and second handle portions 38, 58 provides a reinforced handle so the carrier 150 is capable of withstanding substantial loading without tearing, bending, or otherwise weakening of the carrier when the handle is grasped to carry the containers C. The handle 7 may be otherwise shaped, arranged, and located without departing from the disclosure.

In the illustrated embodiment, the carrier 150 includes end portions 152, 154 (FIG. 7) of one side (e.g., the side including second side wall 40) of the carrier comprise reinforced retaining areas including four plies of material (e.g., the two top panels 30, 50, the reinforcing tabs 23, and the second side panel 40) to provide reinforcement to the areas of the carrier 150 holding the two end containers C. In one embodiment, a central portion 156 between the two end portions 152, 154 includes four plies of material (e.g., the two handle portions 38, 58, top panels 30, 50, the reinforcing tabs 23*a*, and the second side panel 40) when the handle 7 is in the lowered position to provide reinforcement to the area of the carrier holding the middle container C. When the handle 7 is raised, the central portion 156 includes two plies of material (e.g., the reinforcing tab 23*a* and the second side panel 40) holding the middle container C. In the illustrated embodiment, the opposite side of the carrier 150 (e.g., the side corresponding to the first side panel 20) includes two plies of material (e.g., the side panel 20 and the reinforcement tabs 23, 23*a*) to provide reinforcement to the area of the carrier 150 holding the end containers C. The carrier 150 could be otherwise shaped and arranged and could have more or less than two or four plies of material on either or both sides of the carrier.

In the illustrated embodiment, the carrier 150 is retained on the containers C by the engagement of the flaps 12 and reinforcement flaps 23, 23*a* with the portions of the shoulders S of the containers. The edges 39 of the flaps 12 and the edges of the reinforcement flaps 23, 23*a*, corresponding to fold lines 25, form the retaining edges 24 that engage an underside of a respective shoulder S at opposite sides of each container to apply a retention force that tends to prevent withdrawal of each container from the carrier. The retention force from the engagement of the retaining edges 24 with the shoulder S creates an upward bias force that must be overcome or eliminated by tearing or manipulation of the carrier 150, in order to withdraw the container C from the carrier. The retaining edges 24 that retain the containers C at the end portions 152, 154 are supplemented by the two layers of the top wall 52 to add further reinforcement and retention force to the end portions of the carrier 150. The containers C may be otherwise retained in the carrier without departing from the disclosure.

Figure 8:
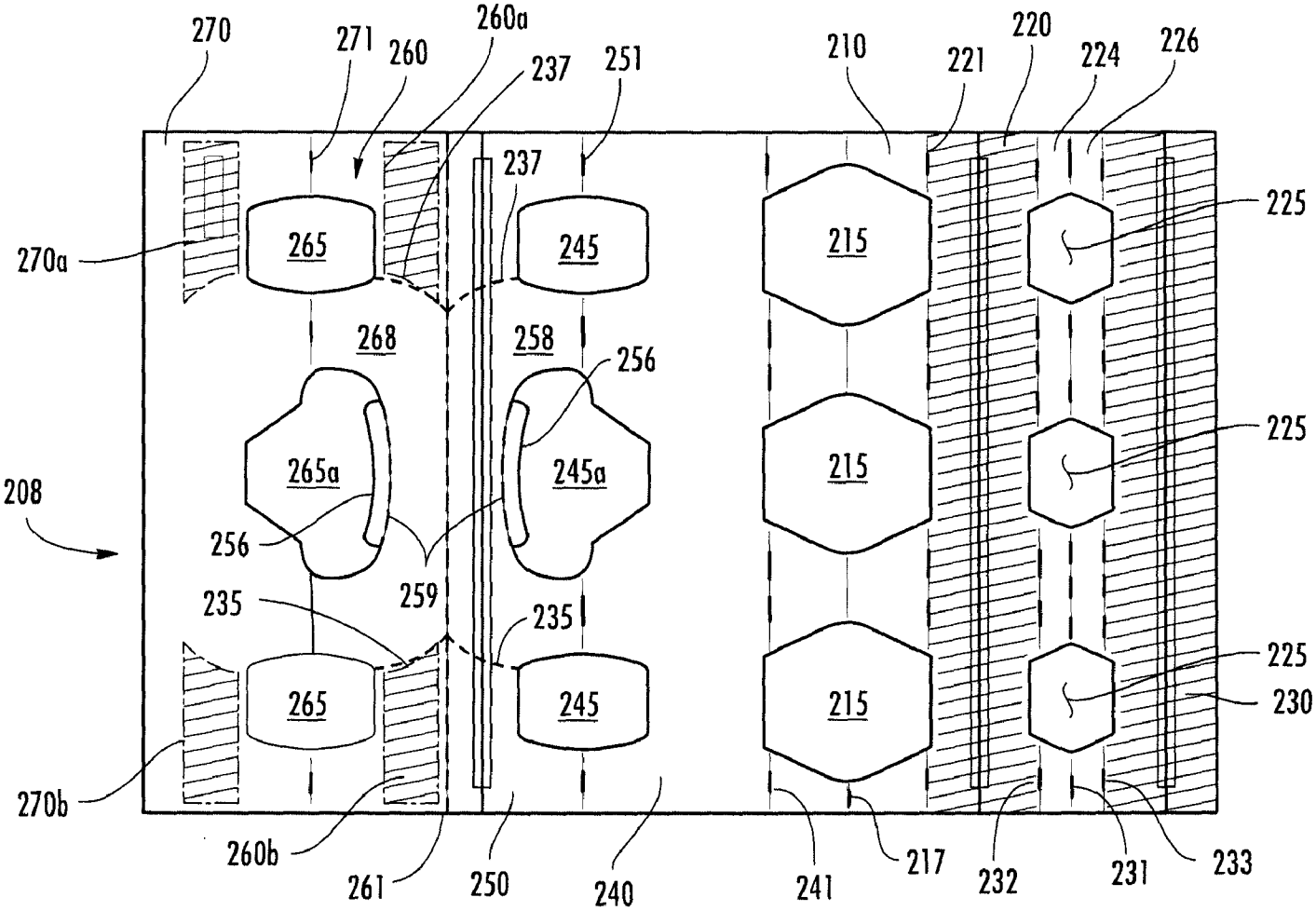
FIG. 8 is a plan view of the exterior side of a blank according to a second embodiment of the disclosure.

FIG. 8 illustrates a blank 208 for forming a carrier 305 (FIGS. 10-13) according to a second embodiment of the disclosure. The second embodiment is generally similar to the first embodiment, except for variations noted and variations that will be apparent to one of ordinary skill in the art. The blank 208 comprises a bottom panel 210 foldably connected to a first side panel 220 at a first transverse fold line 221, a second side panel 230 foldably connected to the first side panel 220 at a second transverse fold line 231, a third side panel 240 foldably connected to the bottom panel 210 at a third transverse fold line 241, a first top panel 250 foldably connected to the third side panel 240 at a fourth transverse fold line 251, a second top panel 260 foldably connected to the first top panel 250 at a fifth transverse fold line 261, and a fourth side panel 270 foldably connected to the second top panel 260 at a sixth transverse fold line 271.

The bottom panel 210 includes openings 215 for respectively, partially receiving the neck portion N of containers C. In the embodiment of FIG. 8, the bottom panel 210 is free from flaps that are moveably positionable in the openings 215, but the blank 208 of the second embodiment could comprises flaps similar to the flaps 12 of the blank 8 shown in FIG. 1. The bottom panel 210 includes a lateral fold line 217 located on the centerline of the bottom panel.

The blank 208 includes openings 225 between the first side panel 220 and second side panel 230 that are aligned with the lateral fold line 231, openings 245, 245*a* between the third side panel 240 and the first top panel 250 that are aligned with the lateral fold line 251, and openings 265, 265*a* between the second top panel 260 and the fourth side panel 270 that are aligned with the lateral fold line 271. When the carrier 305 is assembled from the blank 208, the respective outer and middle openings 215, 225, 245, 245*a*, and 265, 265*a* are axially aligned to receive a respective container C. Intermediate fold lines 232, 233 are situated on either side of fold line 231 and respectively define a portion 224 of the first side panel 220 and a portion 226 of the second side panel 230.

The first top panel 250 includes handle features for forming the handle 307. The handle features include a handle portion 258 at least partially defined by the openings 245, curved tear lines 235, 237 extending from respective openings 245 to the lateral fold line 261, and portions of the lateral fold line 251. Optionally, a comfort flap 256 is foldably attached to the handle portion 258 at a curved tear line 259.

The second top panel 260 includes a second handle portion 268 similar to the first handle portion 258. The handle portions 258, 268 are generally C-shaped for grasping by a user.

Figure 9:
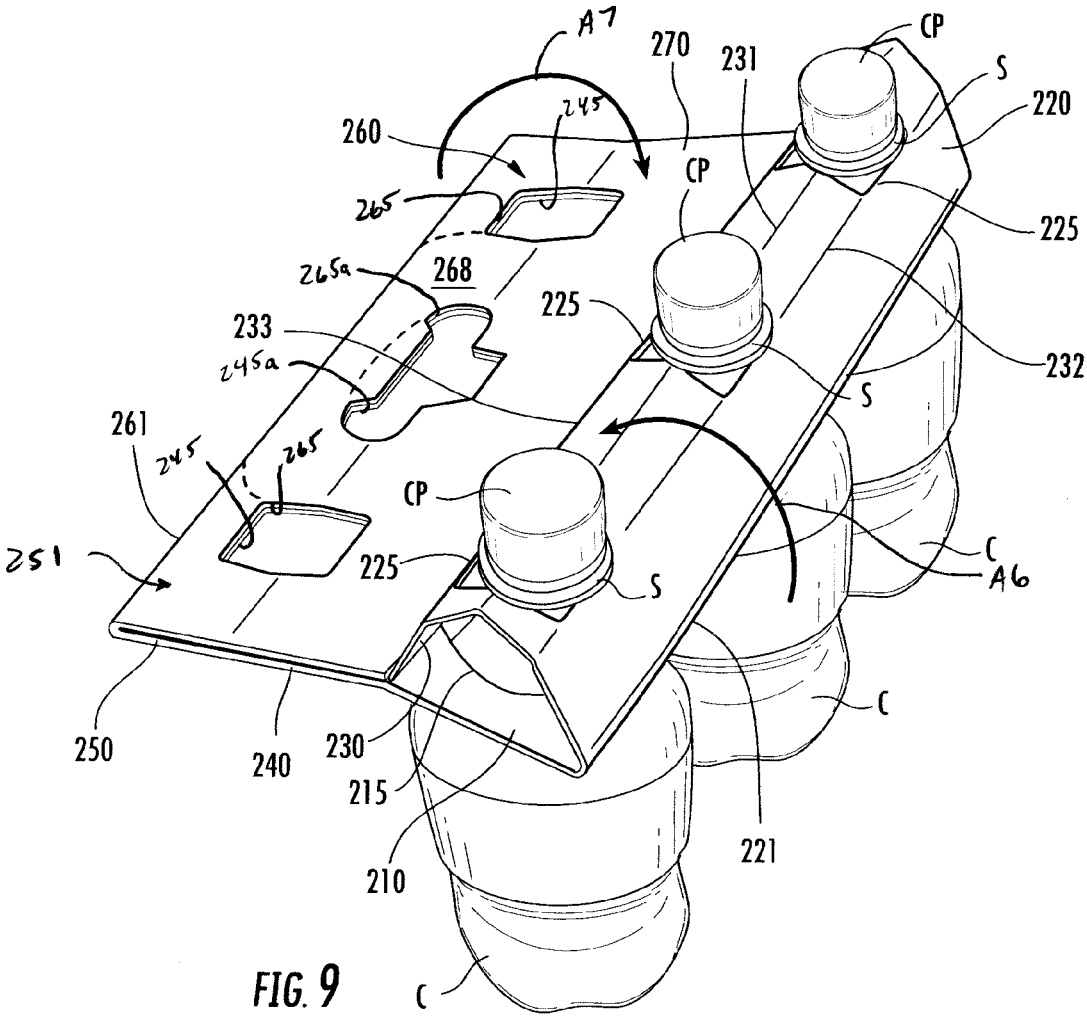
FIGS. 9-11 are perspective views of exemplary steps in assembling the carrier according to the second embodiment of the disclosure.
Figure 10:
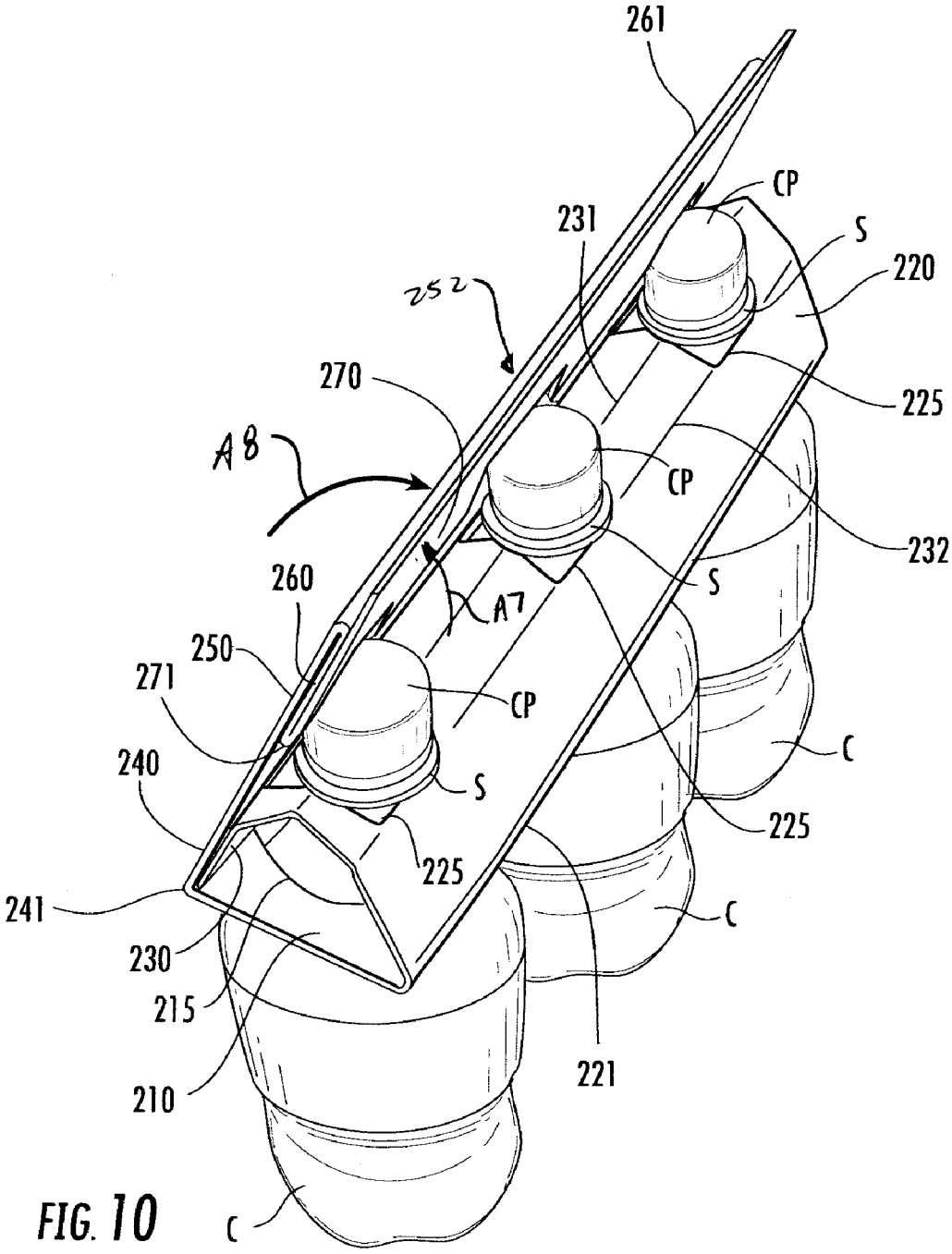
Figure 11:
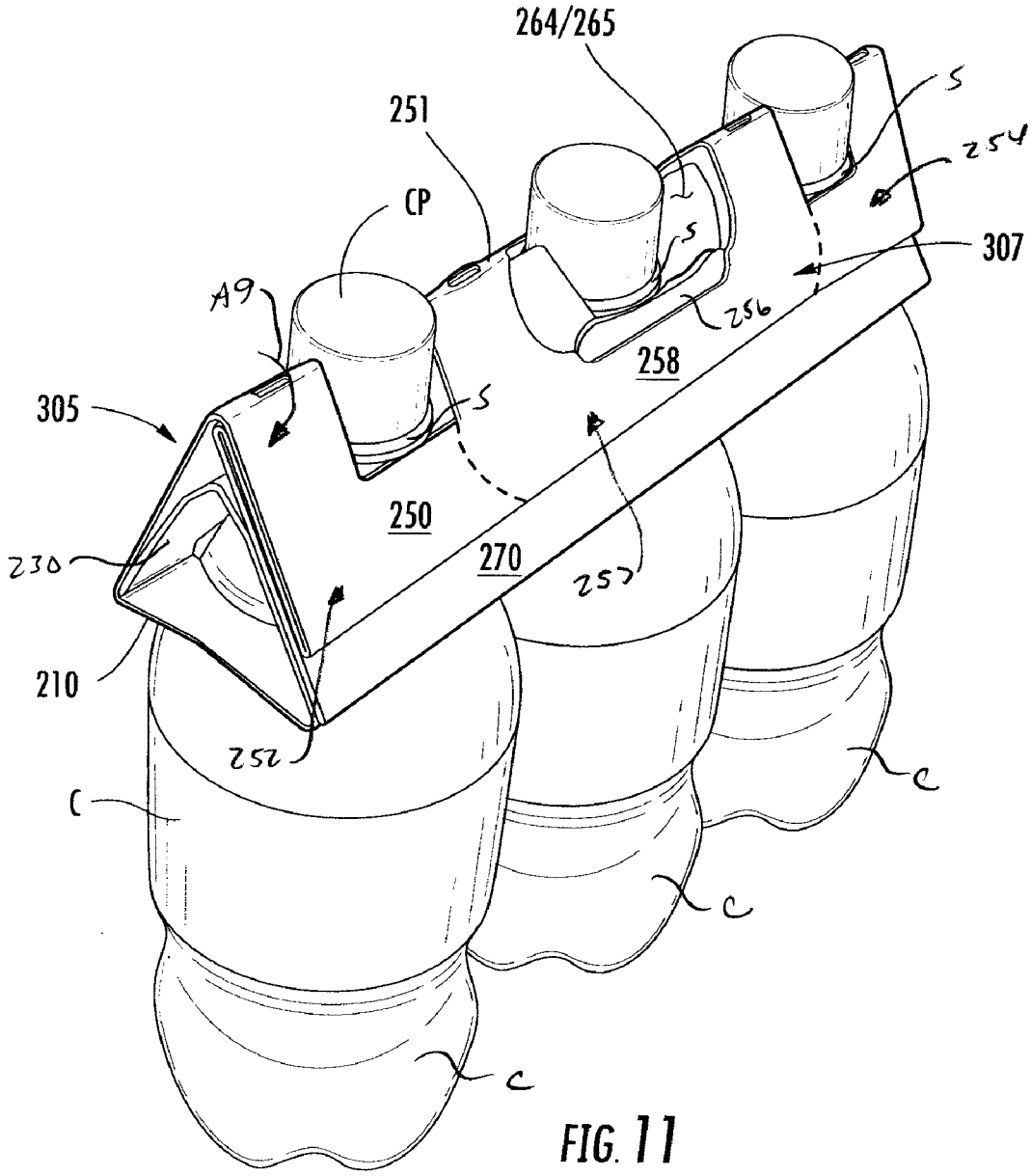
Figure 12:
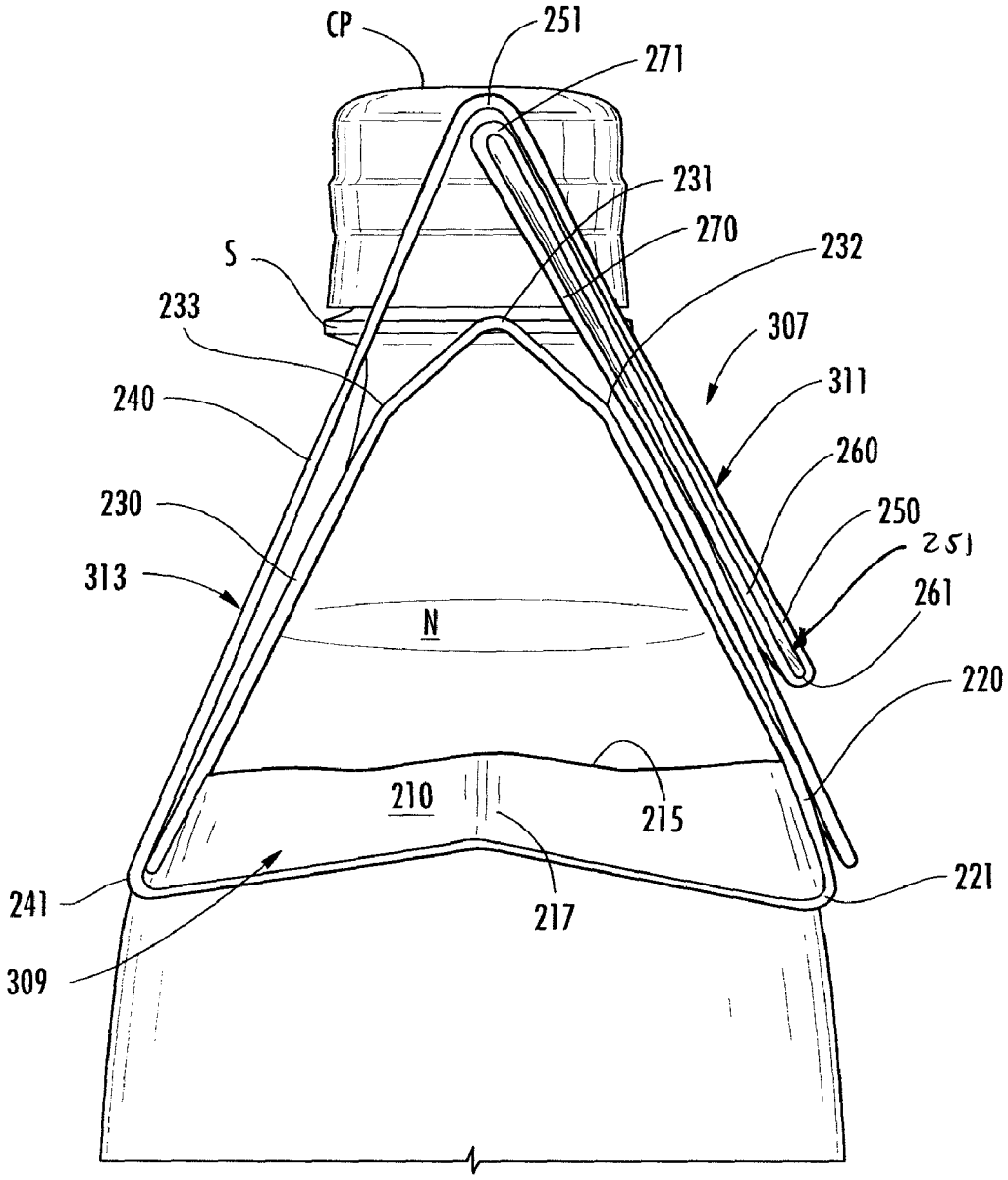
FIG. 12 is an end view of the carrier of FIG. 11.
Figure 13:
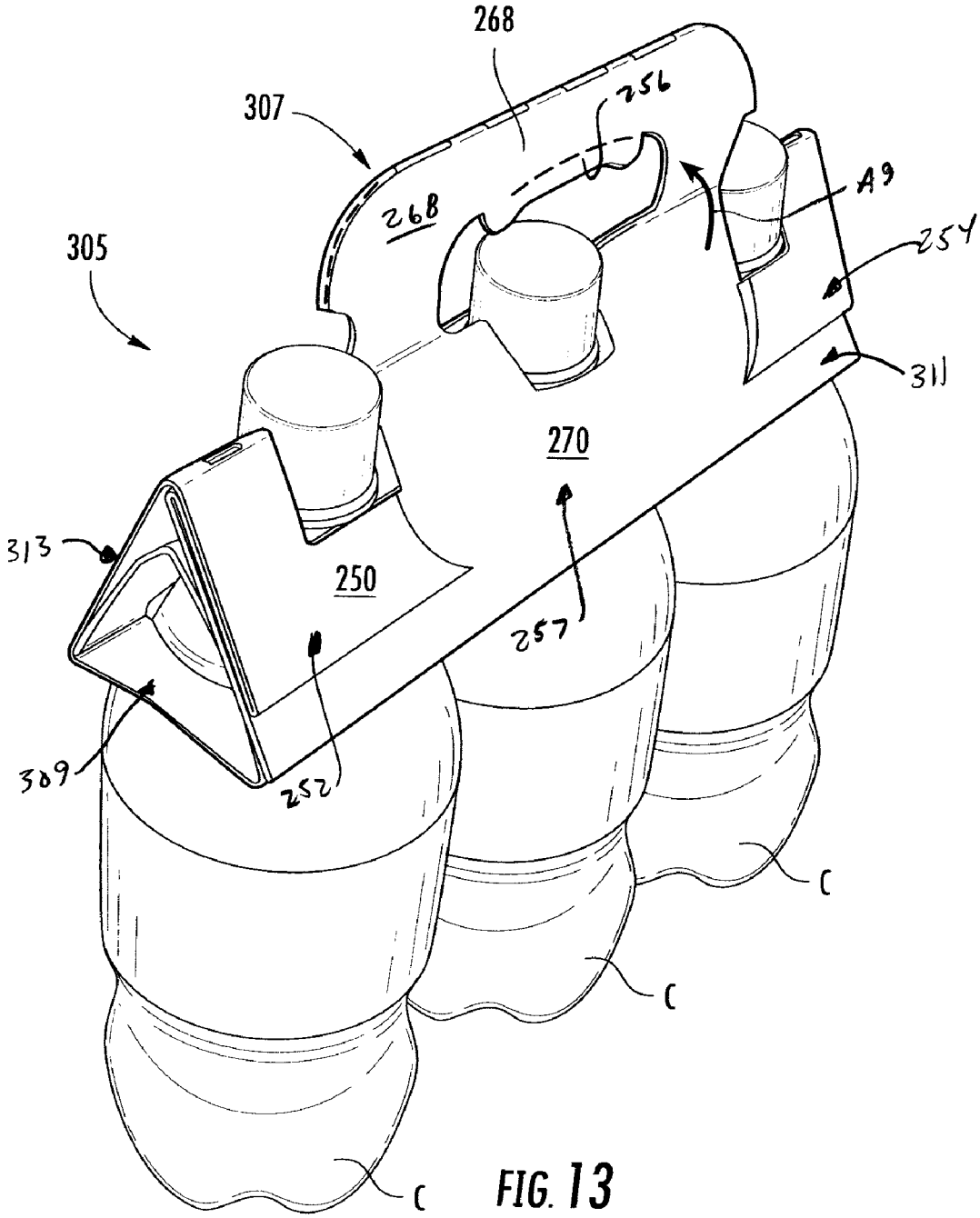
FIG. 13 is a perspective view of the carrier of FIG. 11 with the handle in the raised position.

The blank 208 can be formed into the carrier 305 by placing the bottom panel 210 onto a row of three containers C so that the upper portion N of the containers protrude through the openings 215. As shown in FIG. 9, the first side panel 220 is upwardly folded in the direction of arrow A6 at fold line 221 relative to the bottom panel 210. The second side panel 230 is downwardly folded at fold lines 231, 232, 233 relative to the first side panel 220 so that the bottom panel 210 and first and second side panels form a generally triangular structure with the openings 215, 225 generally axially aligned. The top portion N of the containers extends through the axially-aligned openings 215, 225. Also in FIG. 9, the second top panel 260 and the fourth side panel 270 are folded about the fold line 261 in the direction of arrow A7 to be in face-to-face contact with the first top panel 250 and the third side panel 240, respectively. The first top panel 270 and the second top panel 250 form a top wall 251. Next, as shown in FIG. 10, the fourth side panel 270 is folded about fold line 271 in the direction of arrow A7 to be in generally face-to-face contact with the second handle panel 260. In one embodiment, the third side panel 240 is upwardly folded at fold line 241 in the direction of arrow A8 relative to the bottom panel 210 so that the third side panel is in generally face-to-face contact with the second side panel 230. The combined three layers of the first top panel 250, second top panel 260, and fourth side panel 270 are further folded downwardly at fold line 251 in the direction of arrow A9 to contact the first side panel 220 as shown in FIGS. 11 and 12. In the assembled position of the carrier 305, the tops of the containers C extend through the overlapped openings 245, 265 which are generally axially aligned with the other openings 225, 215 of the blank 208. The carrier 305 may be formed by alternative folding steps and/or other panel arrangements without departing from the disclosure.

In the illustrated embodiment, adhesive may be applied to the laterally outer portions 260*a*, 260*b* of the second top panel 260 to secure handle 307 (FIG. 13) in the downwardly folded position of FIGS. 11 and 12 against fourth side panel 270. Alternatively, adhesive may be applied to the laterally outer portions 270*a*, 270*b* of the fourth side panel 270 to secure the handle 307 in the downwardly folded position. Also, adhesive can be applied to the second side panel 230 to secure the third side panel 240 to the second side panel as shown in the position of FIG. 12. Adhesive can be applied to the first side panel 220 to secure the fourth side panel 270 to the first side panel in the position shown in FIG. 12. Adhesive can be alternatively applied to other surfaces, panels, etc. without departing from the disclosure.

In the assembled position, the carrier 305 is generally triangular-shaped having a bottom 309 (FIG. 12), a first side 311, and a second side 313. In the illustrated embodiment, the first side 311 comprises the first side panel 220, the top wall 251 (i.e., the first top panel 250 and the second top panel 260) that is downwardly folded, and the fourth side panel 270. The second side 313 comprises the second side panel 230 and the third side panel 240. The bottom 309 comprises the bottom panel 210. The carrier 305 can be otherwise shaped and arranged. The edges of the blank 208 forming openings 245, 265 engage shoulders S to retain the containers in the carrier 305. The attached portions of the top panels 250, 260 and the side panels 220, 270 include reinforced retaining areas 252, 254 at the end portions of the side 311 that have four plies or layers of material to provide reinforcement to the areas of the carrier 305 holding the two end containers C. The central portion 257 of the carrier between the end portions 252, 254 also includes four plies or layers of material when the handle is in the lowered position. The side 313 includes two plies (e.g., the second side panel 230 and the third side panel 240) across length of carton.

As with the previous embodiment, the handle 307 is activated by tearing the overlapped handle portions 258, 268 at respective tear lines 235, 237 to position the handle in the raised position (FIG. 13) by folding the handle portions upwardly about overlapped fold lines 251, 271 in the direction of arrow A9. After the handle 307 is raised, the central portion 257 includes two layers or plies of material (e.g., the side panels 220, 270). As with the previous embodiments, the handle 307 can be lowered and retained in the lowered position by the engagement of the edges of the overlapped comfort flaps 265 with the shoulder S of the middle container C.

As with the previous embodiment, the carrier 305 includes retaining edges 324 that engage either side of the shoulder S of each container. In the illustrated embodiment, the retaining edges 324 of side 311 of the carrier 305 include respective edges of the top panel 250 adjacent the openings 245, 245*a*, respective edges of the top panel 260 adjacent openings 265, 265*a*, respective edges of the side panel 270 adjacent openings 265, 265*a*, and respective edges of the side panel 220 adjacent the openings 225. In one embodiment, the retaining edges 324 of side 313 of the carrier 305 include respective edges of the side panel 240 adjacent the openings 245, 245*a*, and respective edges of the side panel 230 adjacent the openings 225. The carrier 305 could be otherwise shaped and arranged and could have other retaining features or reinforcement features without departing from the disclosure.

In general, the blank may be constructed from paperboard having a caliper of at least about 13, for example, so that it is heavier and more rigid than ordinary paper. The blank can also be constructed of other materials, such as cardboard, or any other material having properties suitable for enabling the carton to function at least generally as described above.

The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

The above embodiments may be described as having one or panels adhered together by glue. The term "glue" is intended to encompass all manner of adhesives commonly used to secure paperboard carton panels in place, and the adhesive material can be replaced by, or supplemented with any suitable fastening devices.

The term "line" as used herein includes not only straight lines, but also other types of lines such as curved, curvilinear or angularly displaced lines.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, cut line, or the like. For example, a cut line can be a continuous slit or could be wider than a slit without departing from the present disclosure.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments that are within the scope of the claims. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carrier for holding a plurality of containers, the carrier comprising:

a bottom panel comprising a plurality of bottom openings for at least partially receiving a respective container of the plurality of containers;

at least two side panels extending upward from the bottom panel, the at least two side panels comprising a first side panel and a second side panel;

at least two top panels comprising a first top panel and a second top panel, the first top panel and the second top panel cooperating to form a top wall of the carrier, the first top panel comprises a first handle portion, the second top panel comprises a second handle portion, and the top wall comprises at least one top opening being aligned with at least one bottom opening of the plurality of bottom openings for at least partially receiving a respective container of the plurality of containers;

a handle for carrying the carrier, the handle being foldably connected to at least one of the side panels, the handle comprising the first handle portion and the second handle portion, the handle being separable from the top wall along at least one tear line and pivotable between a lowered position and a raised position, the at least one tear line extending from the at least one top opening in the top wall to a distal edge of the top wall.

2. The carrier of claim 1 wherein the top wall is in face-to-face contact with and adhesively attached to a side panel of the at least two side panels, and at least one of the first handle portion and the second handle portion is in face-to-face contact with the side panel of the at least two side panels, the handle being pivotable away from the side panel of the at least two side panels after tearing along the at least one tear line.

3. The carrier of claim 1 wherein the first side panel comprises a plurality of first side openings and the second side panel comprises a plurality of second side openings, the first side openings and second side openings being aligned with the bottom openings for at least partially receiving a respective container of the plurality of containers.

4. The carrier of claim 3 wherein the at least one top opening of the top wall comprises a plurality of top openings, the plurality of top openings being aligned with one of the plurality of first side openings and the plurality of second side openings for at least partially receiving a respective container of the plurality of containers.

5. The carrier of claim 4 further comprising a plurality of first reinforcement flaps foldably connected to the first side panel and a plurality of second reinforcement flaps foldably connected to the second side panel, the first reinforcement flaps having an edge that is adjacent a respective one of the first side openings and the second reinforcement flaps having and edge that is adjacent a respective one of the second side openings.

6. The carrier of claim 5 further comprising a plurality of retention flaps foldably connected to the bottom panel, each retention flap being adjacent a respective one of the bottom openings.

7. The carrier of claim 6 wherein the reinforcement flaps are in face-to-face contact with a respective one of the retention flaps and one of the first and second side panels, the retention flaps, the reinforcement flaps, and the side panels cooperating to form a plurality of retaining edges of the carrier, each retaining edge of the plurality of retaining edges engages a shoulder of a container to retain the container in the carrier.

8. The carrier of claim 7 wherein at least one of the retaining edges of the carrier comprises four layers of material, the four layers comprising a retention flap, a reinforcement flap, a portion of one of the first and second side panels, and a portion of one of the first and second top panels.

9. The carrier of claim 1 wherein the first and second handle portions are adjacent a respective handle opening in the first and second top panel.

10. The carrier of claim 9 wherein the first and second handle portions are secured together by an adhesive flap foldably connected to one of the first and second handle portions.

11. The carrier of claim 9 wherein each of the first and second handle portions comprises a comfort flap foldably connected to the handle portion and adjacent a respective handle opening.

12. The carrier of claim 9 wherein the comfort flap of the first and second handle portions engages a shoulder of one of the containers of the plurality of containers to retain the handle in the lowered position.

13. The carrier of claim 1 comprising reinforced retaining areas for contacting and retaining a respective container of the plurality of containers, each reinforced retaining area contacting a shoulder of the respective container, and at least one of the reinforced retaining areas comprising five layers of material.

14. The carrier of claim 1 wherein the carrier has a generally triangular cross-sectional shape.

15. The carrier of claim 1 wherein the at least two side panels further comprises a third side panel and a fourth side panel, the second and third side panels cooperate to form a two-ply side wall of the carrier.

16. The carrier of claim 15 wherein the first side panel, fourth side panel, first top panel, and second top panel cooperate to form a four-ply side wall of the carrier.

17. The carrier of claim 1 wherein the first side panel and the second side panel are respectively foldably connected to the bottom panel, the first top panel is foldably connected to the first side panel, and the second top panel is foldably connected to the second side panel.

18. The carrier of claim 15 wherein the first side panel is foldably connected to the bottom panel by a first fold line, the second side panel is foldably connected to the first side panel by a second fold line, the third side panel is foldably connected to the bottom panel by a third fold line, the first top panel is foldably connected to the third side panel by a fourth fold line, the second top panel is foldably connected to the first top panel by a fifth fold line, the fifth fold line forming the distal edge of the top wall, and the fourth side panel is foldably connected to the second top panel by a sixth fold line.

19. The carrier of claim 18 comprising reinforced retaining areas for contacting and retaining a respective container of the plurality of containers, the reinforced retaining areas comprising four layers of material, the reinforce retaining areas comprising at least a portion of the first side panel, at least a portion of the fourth side panel, at least a portion of the first top panel, and at least a portion of the second top panel.

20. A blank for forming a carrier for holding a plurality of containers, the blank comprising:

a bottom panel comprising a plurality of bottom openings for at least partially receiving a respective container of the plurality of containers;

at least two side panels comprising a first side panel and a second side panel;

at least two top panels comprising a first top panel and a second top panel, the first top panel comprises a first handle portion, the second top panel comprises a second handle portion, and each of the first top panel and the second top panel comprises at least one top opening being aligned with at least one bottom opening of the plurality of bottom openings for at least partially receiving a respective container of the plurality of containers when the carrier is formed from the blank;

handle features for forming a handle of the carrier formed from the blank, the handle features comprising the first handle portion and the second handle portion, the first and second handle portions being respectively foldably connected to one of the first side panel and the second side panel, at least one of the first handle portion and the second handle portion being separable from the respective first top panel and second top panel along at least one tear line, the at least one tear line extending from the at least one top opening in at least one of the first top panel and the second top panel to a respective edge of the at least one of the first top panel and the second top panel.

21. The blank of claim 20 wherein the first side panel comprises a plurality of first side openings and the second side panel comprises a plurality of second side openings.

22. The blank of claim 21 wherein the at least one top opening of the first top panel and the second top panel comprises a plurality of top openings, each top opening of the plurality of top openings being respectively aligned with one of the plurality of first side openings, one of the plurality of second side openings, and one of the bottom openings when the blank is formed into the carrier.

23. The blank of claim 21 further comprising a plurality of first reinforcement flaps foldably connected to the first side panel and a plurality of second reinforcement flaps foldably connected to the second side panel, the first reinforcement flaps being adjacent a respective one of the first side openings and the second reinforcement flaps being adjacent a respective one of the second side openings.

24. The blank of claim 23 further comprising a plurality of retention flaps foldably connected to the bottom panel, each retention flap being adjacent a respective one of the bottom openings, each retention flap, each first reinforcement flap, and each second reinforcement flap being for engaging a respective container of the plurality of containers at a respective shoulder when the carrier is formed from the blank.

25. The blank of claim 23 wherein the first and second handle portions are adjacent a respective handle opening in the first and second top panel and are separable from a respective one of the first and second top panels at a tear line.

26. The blank of claim 25 further comprising an adhesive flap foldably connected to at least one of the first and second handle portions.

27. The blank of claim 26 wherein each of the first and second handle portions comprises a comfort flap foldably connected to the handle portion and adjacent a respective handle opening.

28. The blank of claim 20 wherein the first side panel and the second side panel are respectively foldably connected to the bottom panel, the first top panel is foldably connected to the first side panel, and the second top panel is foldably connected to the second side panel.

29. The blank of claim 20 wherein the at least two side panels further comprises a third side panel and a fourth side panel, wherein the first side panel is foldably connected to the bottom panel by a first fold line, the second side panel is foldably connected to the first side panel by a second fold line, the third side panel is foldably connected to the bottom panel by a third fold line, the first top panel is foldably connected to the third side panel by a fourth fold line, the second top panel is foldably connected to the first top panel by a fifth fold line, the fifth fold line forming the respective edge of the at least one of the first top panel and the second top panel, and the fourth side panel is foldably connected to the second top panel by a sixth fold line.

30. A method of forming a carrier for containing a plurality of containers, the method comprising:

obtaining a blank having a bottom panel comprising a plurality of bottom openings, at least two side panels comprising a first side panel and a second side panel, at least two top panels comprising a first top panel and a second top panel, the first top panel comprising a first handle portion, the second top panel comprising a second handle portion, the blank comprising handle features comprising the first handle portion and the second handle portion;

respectively upwardly folding the at least two side panels to position the side panels to extend upwardly from the bottom panel;

forming a top wall by placing the first top panel and the second top panel in generally face-to-face relationship, the forming the top wall comprises forming a handle by placing the first handle portion and the second handle portion in generally face-to-face relationship, the to wall comprises at least one to opening being aligned with at least one bottom opening of the plurality of bottom openings;

downwardly folding the top wall, the downwardly folding the top wall comprises placing the handle in a lowered position adjacent to one of the side panels; and separating the handle from the top wall along at least one tear line and pivoting the handle between a lowered position and a raised position, the at least one tear line extending from the at least one top opening in the top wall to a distal edge of the top wall.

31. The method of claim 30 further comprising adhesively attaching the top wall to the one of the side panels.

32. The method of claim 30 further comprising at least partially inserting a respective container of the plurality of containers into a respective bottom opening.

33. The method of claim 32 wherein the blank further comprises a plurality of first side openings in the first side panel, a plurality of second side openings in the second side panel, the upwardly folding the two side panels comprises respectively aligning the first side openings and the second side openings with the bottom openings, the method further comprises further inserting a respective container of the plurality of containers into one of the plurality of first side openings and one of the plurality of second side openings.

34. The method of claim 33 wherein the at least one top opening comprises a plurality of top openings in the top wall, the downwardly folding the top wall comprises respectively aligning the top openings with the first side openings, second side openings, and bottom openings, the method further comprises inserting a respective container of the plurality of containers into one of the plurality of top openings.

35. The method of claim 34 wherein the blank comprises a plurality of first reinforcement flaps foldably connected to the first side panel and adjacent a respective one of the first side openings, a plurality of second reinforcement flaps foldably connected to the second side panel and adjacent a respective one of the second side openings, and a plurality of retention flaps foldably connected to the bottom panel and adjacent a respective one of the bottom openings, the method further comprising respectively folding the first and second reinforcement flaps, the retention flaps, and at least one of the side panels to form a plurality a reinforced retaining areas that engage a respective container inserted into the carrier, the reinforced retaining areas comprising four layers of material, the four layers of material comprising a retention flap, a reinforcement flap, a portion of one of the first and second side panels, and a portion of one of the first and second top panel.

36. The method of 30 wherein the at least one tear line comprises at least two tear lines, and the first handle portion and the second handle portion are respectively connected to the first top panel and the second top panel at respective tear lines of the at least two tear lines, the separating the handle from the top wall comprising tearing along the at least two tear lines.

37. The method of claim 30 wherein each of the first and second handle portions comprises a comfort flap adjacent a handle opening that engages one of the containers of the plurality of container to retain the handle in the lowered position.

38. The carrier of claim 1 wherein the at least one tear line comprises two first curved tear lines and two second curved tear lines, the first handle portion being separable from a remainder of the first top panel along the two first curved tear lines, and the second handle portion being separable from a remainder of the second top panel along the two second curved tear lines.

39. The carrier of claim 1 further comprising at least one first retention flap, at least one second retention flap, at least one first reinforcement flap, and at least one second reinforcement flap, wherein:

the at least one first retention flap is foldably connected to at least one of the first side panel and the bottom panel adjacent at least one bottom opening of the plurality of bottom openings, and the at least one second retention flap is foldably connected to at least one of the second side panel and the bottom panel adjacent the at least one bottom opening of the plurality of bottom openings;

the at least one first reinforcement flap is foldably connected to the first side panel at a first fold line, and the at least one second reinforcement flap is foldably connected to the second side panel at a second fold line, the first side panel and the at least one first reinforcement flap contacting a shoulder of a respective container of the plurality of containers at the first fold line on a first side of the respective container, and the second side panel and the at least one second reinforcement flap contacting the shoulder of the respective container at the second fold line on a second side of the respective container; and the at least one first retention flap comprises a first retention edge, and the at least one second retention flap comprises a second retention edge, the at least one first retention flap contacting the shoulder of the respective container at the first retention edge on the first side of the respective container, and the at least one second retention flap contacting the shoulder of the respective container at the second retention edge on the second side of the respective container.

40. The blank of claim 20 wherein the at least one tear line comprises two first curved tear lines and two second curved tear lines, the first handle portion being separable from a remainder of the first top panel along the two first curved tear lines, and the second handle portion being separable from a remainder of the second top panel along the two second curved tear lines.

41. The blank of claim 20 further comprising at least one first retention flap, at least one second retention flap, at least one first reinforcement flap, and at least one second reinforcement flap, wherein:

the at least one first retention flap is foldably connected to at least one of the first side panel and the bottom panel adjacent at least one bottom opening of the plurality of bottom openings, and the at least one second retention flap is foldably connected to at least one of the second side panel and the bottom panel adjacent the at least one bottom opening of the plurality of bottom openings;

the at least one first reinforcement flap is foldably connected to the first side panel at a first fold line, and the at least one second reinforcement flap is foldably connected to the second side panel at a second fold line, the first side panel and the at least one first reinforcement flap being for contacting a shoulder of a respective container of the plurality of containers at the first fold line on a first side of the respective container, and the second side panel and the at least one second reinforcement flap being for contacting the shoulder of the respective container at the second fold line on a second side of the respective container when the carrier is formed from the blank; and the at least one first retention flap comprises a first retention edge, and the at least one second retention flap comprises a second retention edge, the at least one first retention flap being for contacting the shoulder of the respective container at the first retention edge on the first side of the respective container when the carrier is formed from the blank, and the at least one second retention flap being for contacting the shoulder of the respective container at the second retention edge on the second side of the respective container when the carrier is formed from the blank.

* * * * *